United States Patent [19]

Solter

[11] Patent Number: 5,035,401

[45] Date of Patent: Jul. 30, 1991

[54] WOOD RAILING WITH METAL FOUNDATION

[76] Inventor: Frederick H. Solter, 419 Mark Dr., Simi Valley, Calif. 93065

[21] Appl. No.: 3,128

[22] Filed: Jan. 14, 1987

[51] Int. Cl.[5] ..... E04H 17/14

[52] U.S. Cl. ..... 256/19; 256/59; 52/727

[58] Field of Search ..... 256/59, 19; 52/727

[56] References Cited

U.S. PATENT DOCUMENTS

| | | | |
|---|---|---|---|
| D. 213,097 | 1/1969 | Blum et al. . | |
| 1,526,638 | 2/1925 | Knight . | |
| 2,158,291 | 5/1939 | Lank | 52/727 |
| 2,679,074 | 5/1954 | Bryden | 52/727 X |
| 2,808,233 | 4/1955 | Spescha . | |
| 2,945,679 | 7/1960 | Blum . | |
| 3,200,554 | 8/1963 | Goodman et al. | 52/727 |
| 3,289,381 | 6/1964 | Blum et al. . | |
| 3,300,192 | 10/1964 | Blum et al. . | |
| 3,356,392 | 12/1965 | Blum et al. . | |
| 3,358,969 | 12/1965 | Blum et al. . | |
| 3,804,374 | 4/1974 | Thom | 256/59 |
| 3,993,289 | 11/1976 | Lewis et al. | 256/59 |
| 4,138,094 | 2/1979 | Thir . | |
| 4,272,061 | 6/1981 | Suckno . | |
| 4,441,299 | 4/1984 | Gries | 52/727 X |

FOREIGN PATENT DOCUMENTS

| | | | |
|---|---|---|---|
| 128223 | 9/1920 | United Kingdom | 256/59 |

*Primary Examiner*—Andrew V. Kundrat
*Attorney, Agent, or Firm*—Lyon & Lyon

[57] ABSTRACT

A wooden railing or divider having a reinforcing metal foundation includes a metal substructure of upper and lower rail members connected by balusters, and a wooden superstructure comprising wooden elements positioned to enclose the metal substructure elements.

6 Claims, 2 Drawing Sheets

FIG. 1.
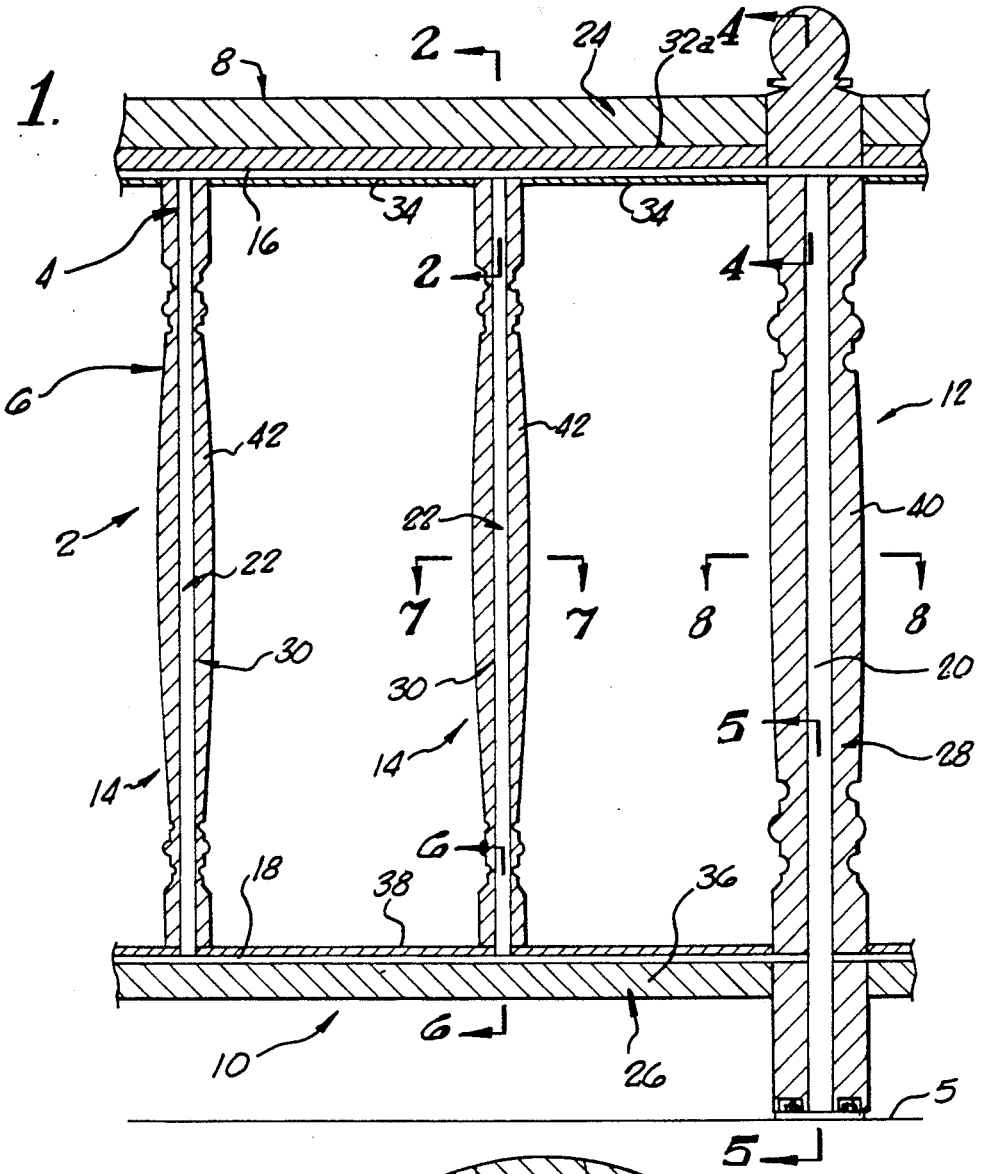
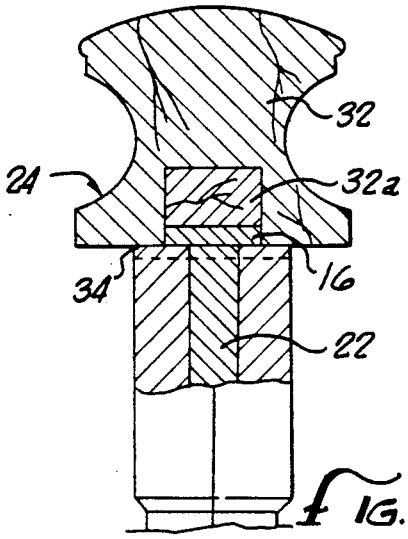
FIG. 2.
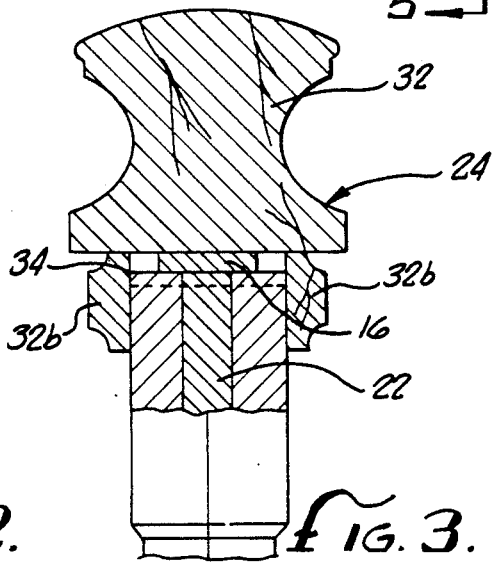
FIG. 3.

WOOD RAILING WITH METAL FOUNDATION

BACKGROUND

The field of the present invention is railings and dividers for use in structures.

The use of railings and dividers in one form or another probably dates back to the advent of civilized society. Railings have been used in conjunction with stairs, balconies, decks, and the like to demarcate the boundaries thereof for safety and other reasons. Dividers have been employed to designate areas of, for example, a room, and perhaps to confine persons to a specific area. Dividers are found in such places as courtrooms, legislative halls and the like where access to a particular area is to be restricted.

The earliest railings and dividers were likely constructed of stone or wood, depending on intended use, availability of raw materials and the architectural style in vogue at the time. In ancient Mediterranean cultures, for example, one would expect to find a predominance of stone-made structures. In more recent times, particularly in Europe and North America, wooden railings and dividers have predominated. Indeed, until relatively recently, the architectural tendency has been to provide ornate wooden structures of intricate design.

With the advent of readily available metals and plastics for structural applications, wood for railings, dividers and other structures has been used with decreasing frequency. The new materials are generally stronger and more durable and are therefore preferred, especially where safety considerations are important.

Notwithstanding the superior structural attributes of metal and other materials, they are often aesthetically bland and lack the warmth and artistry associated with finely-crafted wooden structures. While the architectual trend in recent years has been toward a "functional" look, there are many who still prefer traditional stylings. Indeed, recent designs reveal a resurgence of more conservative constructions in residential and other structures. For those applications, a traditionally styled wooden railing or divider possessing the strength and durability found in a structure constructed from metal or the like would be desirable.

SUMMARY OF THE INVENTION

The present invention is directed to a wooden railing or divider having a metal foundation. To this end, a metal substructure provides a foundation for decorative wooden elements arranged about the substructure.

BRIEF DESCRIPTION OF THE DRAWINGS

FIG. 1 is a cross-sectional view of a railing or divider constructed in accordance with the present invention, including a metal substructure and a wooden element (shaded) attached thereto.

FIG. 2 is a partial cross-sectional view taken along line 2—2 in FIG. 1 showing the intersection of a baluster and the handrail.

FIG. 3 is a partial cross-sectional view similar to FIG. 2.

DETAILED DESCRIPTION OF THE PREFERRED EMBODIMENT

Figure 4:
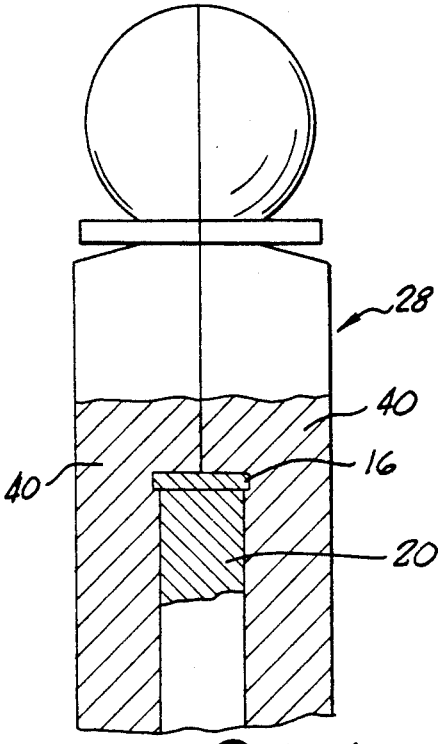
FIG. 4 is a cross-sectional view taken along line 4—4 in FIG. 1 showing the intersection of a post member and the handrail.

Referring to FIG. 1, a railing or divider assembly 2 comprises a metal railing or divider 4 forming a foundation or substructure and a wooden railing or divider 6 forming a superstructure that completely surrounds the metal foundation 4. The metal foundation 4 is made from wrought iron or other suitable material while the super-structure 6 is formed from any suitable wood. The wood may be decoratively shaped in a variety of forms as required. The railing or divider assembly 2 includes a handrail assembly 8, a footrail assembly 10, a post member assembly 12 and baluster assemblies 14.

Correspondingly, the metal foundation 4 includes a metal handrail 16, a metal footrail 18, a metal post member 20 and metal balusters 22. These components are preferably welded together. The bottom of the metal post member is affixed to a surface 5 by bolting or other suitable means.

In similar fashion, the wooden superstructure 6 includes a wooden handrail assembly 24, a wooden footrail assembly 26, a wooden post assembly 28 and wooden baluster assemblies 30. These assemblies are secured together by adhesive or other suitable means. As shown in FIGS. 2 and 3, the wooden handrail assembly 24 comprises a wooden handrail member 32 mounted on the metal handrail member 16. If desired, the wooden handrail member 32 may be grooved. This would be preferable where the metal handrail member 16 has a square cross-section. When the metal handrail member 16 is relatively flat, a grooved wooden handrail member 32 may still be used but it may be necessary to employ a shim 32a to adjust the height of the wooden handrail member 32, as in FIG. 2. If a non-grooved wooden handrail member 32 is employed, it will be necessary to use wooden strip members 32b to mask the metal handrail member 16, as in FIG. 3. To fully mask the metal handrail member 16 between successive balusters, a wooden strip or fillet block 34 is used.

Figure 6:
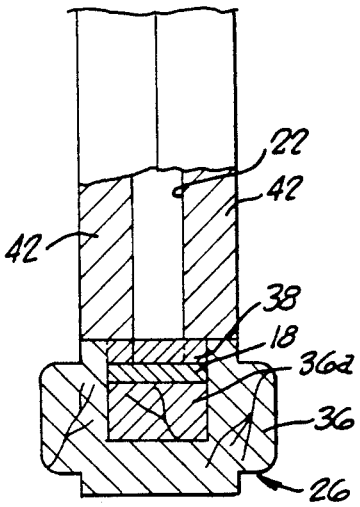
FIG. 6 is a cross-sectional view taken along line 6—6 in FIG. 1 showing the intersection between a baluster and the footrail.
Figure 7:
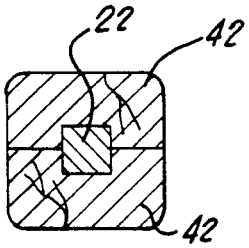
FIG. 7 is a cross-sectional view taken along line 7—7 in FIG. 1 showing the construction of a baluster.

As shown in FIG. 6, the wooden footrail assembly member 26 comprises a wooden footrail member 36 which is grooved to accommodate the metal footrail member 18. A shim 36a allows for adjustment of the height of the wooden footrail member 36. A wooden strip or fillet block 38 is used to mask the metal footrail member 18 between successive balusters.

Figure 5:
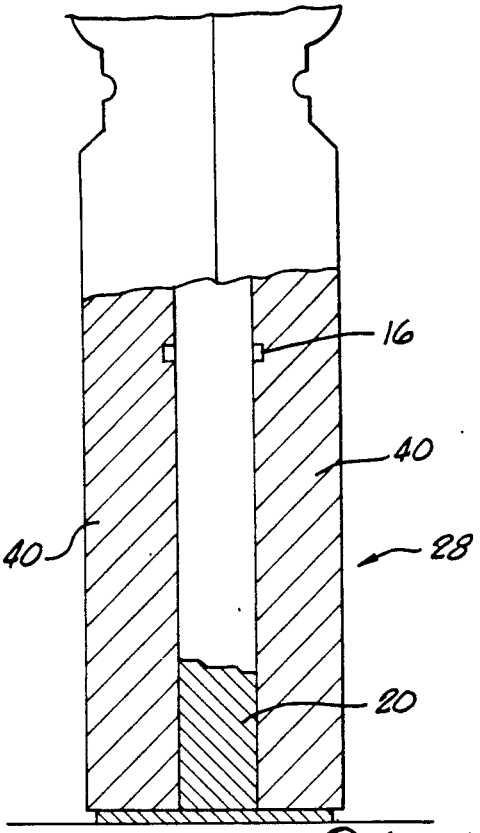
FIG. 5 is a cross-sectional view taken along line 5—5 in FIG. 1 showing the intersection of a post member and the footrail.
Figure 8:
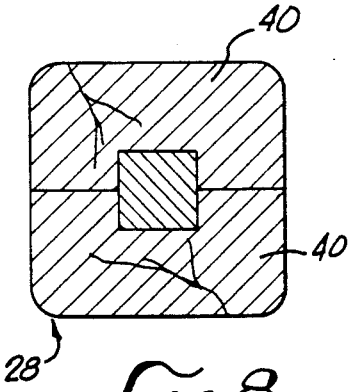
FIG. 8 is a cross-sectional view taken along line 8—8 in FIG. 1 showing the construction of a post member.

Turning to FIGS. 4, 5, and 8, the wooden post member assembly 28 comprises a pair of wooden postmembers 40 which are grooved to accommodate the metal post member 20 and the metal handrail member 16.

As shown in FIGS. 2, 3, 6, and 7, the wooden baluster assemblies 30 comprise a pair of wooden baluster members 42 that are grooved to accommodate the metal baluster members 22.

Thus, a wooden railing with a metal foundation has been disclosed. While embodiments and applications of the invention have been shown and described, it would be apparent to those skilled in the art that many more modifications are possible without departing from the inventive concepts herein. The invention therefore, is not to be restricted except in the spirit of the appended claims.

What is claimed is:

1. A railing or divider comprising an upper metal rail member, a lower metal member, metal balusters extending between and affixed to said upper and lower metal rail members, and wooden members mounted on said metal members and configured to surround same, wherein said upper metal rail member is surrounded by a grooved wooden handrail mounted above said metal rail member and a wooden strip mounted below said rail member.

2. The railing set forth in claim 1 wherein the groove of said grooved wooden handrail is sized to permit adjustment of the height of said wooden handrail, said railing further including a shim member disposed in said groove to adjust the height of said wooden handrail.

3. A railing or divider comprising an upper metal rail member, a lower metal rail member, metal balusters extending between and affixed to said upper and lower metal rail members, and wooden members mounted on said metal members and configured to surround same, wherein said upper metal rail member is surrounded by a wooden hand-rail mounted above said metal rail member and wooden strips mounted below and on each side of said metal rail member.

4. A railing or divider comprising and upper metal rail member, a lower metal rail member, metal balusters extending between and affixed to said upper and lower metal members, and wooden members mounted on said metal members and configured to surround same, wherein said lower metal rail member is surrounded by a grooved wooden foot rail mounted below said metal rail member and a wooden strip mounted above said metal rail member.

5. The railing set forth in claim 4 wherein the groove of grooved wooden footrail is sized to permit adjustment of the height of said wooded footrail, said railing further including a shim member disposed in said groove to adjust the height of said wooden footrail.

6. A railing or divider comprising:

an upper metal rail member;

an upper metal rail member;

metal balusters extending between and affixed to said upper and lower metal rail members;*and wooden members mounted on said metal members and configured to surround same;

said metal balusters are surrounded by a pair of grooved wooden balusters, the grooves of said wooden balusters being sized such that the metal balusters will be enclosed by the wooden balusters.

* * * * *